US005134909A

United States Patent [19]

Sasaki

[11] Patent Number: 5,134,909

[45] Date of Patent: Aug. 4, 1992

[54] POWER DRIVEN SCREWDRIVER

[75] Inventor: Katsuhiko Sasaki, Anjo, Japan

[73] Assignee: Makita Corporation, Anjo, Japan

[21] Appl. No.: 760,508

[22] Filed: Sep. 16, 1991

[30] Foreign Application Priority Data

Sep. 19, 1990 [JP] Japan ..... 2-251282

[51] Int. Cl.[5] ..... B25B 23/157

[52] U.S. Cl. ..... 81/473; 81/467; 173/176; 192/48.3; 192/56 R

[58] Field of Search ..... 81/429, 467, 473–476; 192/56 R, 56 C, 158, 48.1, 48.3–48.5; 173/12

[56] References Cited

U.S. PATENT DOCUMENTS 4,655,103 4/1987 Schreiber et al. ..... 81/474
4,809,572 3/1989 Sasaki ..... 81/429
5,025,903 6/1991 Elligson ..... 192/56 R X

*Primary Examiner*—James G. Smith

*Attorney, Agent, or Firm*—Dennison, Meserole, Pollack & Scheiner

[57] ABSTRACT

A power driven screwdriver includes a driving mechanism interposed between the drive motor and the spindle. The driving mechanism includes a first member rotatably mounted within the housing and a second member movably mounted to the first member and driven by the driver motor. A cam mechanism is interposed between the first member and the second member and is operable for transmitting rotation of the second member to the first member and for permitting the second member to move between a first position and a second position. The second member is movable from a first position to the second position as torque transmitted from the second member to the first member increases. A frictional clutch mechanism is interposed between the spindle and the first member for transmitting rotation of the first member to the spindle. A claw clutch mechanism is interposed between the spindle and the second member and is operable to be engaged when the second member is positioned at the second position.

16 Claims, 11 Drawing Sheets

POWER DRIVEN SCREWDRIVER

BACKGROUND OF THE INVENTION

1. Field of the Invention

The present invention relates to a power driven screwdriver having a clutch mechanism for transmitting rotation of a drive motor to a spindle with a driver bit.

2. Description of the Prior Art

In a power driven screwdriver, a clutch mechanism is provided for transmitting and disconnecting the rotation of a drive motor to a spindle with a driver bit. The clutch mechanism is normally constructed as a claw clutch and includes a pair of clutch members, one of which is mounted on the spindle and the other of which is mounted on a main gear driven by the drive motor. The spindle is movable in an axial direction for engaging and disengaging the clutch members. With such a clutch mechanism constructed by a simple claw clutch, since the rotation of the spindle is restrained, for example, at the completion of a screw driving operation, the clutch mechanism temporarily repeats its engaging and disengaging operation. This will generate clanging sounds, giving unpleasant feeling to the operator, and cause early wear of the clutch mechanism.

U.S. Pat. No. 4,655,103 discloses a power driven screwdriver including stopper for adjusting the driving a amount of a screw by a driver bit. A claw clutch mechanism is provided between a driver shaft and a spindle movable in an axial direction. The claw clutch mechanism includes a first and a second clutch member formed on the driver shaft and the spindle, respectively. A clutch disc is interposed between the driver shaft and the spindle and includes a third and a fourth clutch member for engagement with the first and second clutch members respectively. A spring is interposed between the first and third clutch members for normally keeping them at a disengaging position. The second and fourth clutch members includes relief portions which serves not to transmit rotation. When the stopper abuts on a work to be screwed, the driver shaft continues rotation while the rotation of the spindle is prevented. This may cause the operation of the relief portions of the second and fourth clutch members to positively disengage the first and the third clutch members with the aid of the spring.

U.S. Pat. No. 4,809,572 discloses a power driven screwdriver including a stopper sleeve for adjusting the driving amount of a screw and a claw clutch mechanism having a pair of clutch members, one of which is mounted on a main gear driven by a drive motor, while the other of which is mounted on a spindle. A spring is provided for normally keeping the clutch member of the spindle out of engagement with the clutch member of the main gear. A control mechanism is provided between the spindle and the clutch member mounted on the spindle. The control mechanism includes oblique recesses and a ball for engagement with the recesses. With such construction, when the stopper sleeve abuts on a work to be screwed, the main gear continues its rotation while the rotation of the spindle is prevented. In this stage, the control mechanism operates to positively move the clutch member of the spindle out of engagement with the clutch member of the main gear with the aid of the spring.

However, with the above prior U.S. Patents, the operation of the clutch mechanism must accompany a reciprocal movement of the spindle at a long distance. In general, a power driven screwdriver is provided with a seal member for sealing between a spindle and a housing to prevent entry of dust within the housing. In case the spindle reciprocally moves at a long distance, the dust may be absorbed into the housing through the ga between the seal member and the spindle or the housing by the pumping effect. Thus, when the spindle moves into the housing, negative pressure will be created in the housing. Such dust entered into the housing may cause early wear or damage of the clutch mechanism or bearings disposed within the housing.

Further, with the clutch mechanism of the above U.S. Patents, after the stopper or the stopper sleeve has abutted on the work, no further driving operation cannot be made even if the driving of a screw wa insufficient.

SUMMARY OF THE INVENTION

It is, accordingly, an object of the present invention to provide a power driven screwdriver having a clutch mechanism which may be smoothly disengaged at the completion of a screw driving operation so as to avoid unpleasant clanging sounds.

It is another object of the present invention to provide a power driven screwdriver which may prevent entry of dust into a housing during a screw driving operation.

It is a further object of the present invention to provide a power driven screwdriver which permits a further driving operation of a screw after completion of a first screwing operation if the screw has not been sufficiently driven.

According to the present invention, there is provided a power driven screwdriver comprising:

a housing;

a drive motor mounted within the housing;

a spindle rotatably mounted within the housing for engagement with a driver bit for driving a screw;

a driving mechanism interposed between the drive motor and the spindle for transmitting rotation of the drive motor to the spindle, the driving mechanism including a first member rotatably mounted within the housing and a second member movably mounted on the first member and driven by the drive motor;

a cam mechanism interposed between the first member and the second member of the driving mechanism, the cam mechanism interconnecting the first member with the second member for transmitting rotation of the second member to the first member and for permitting the second member to move relative to the first member between a first position and a second position;

a biasing element for normally keeping the second member at the first position and for permitting the second member to move from the first position to the second position as torque transmitted from the second member to the first member increases;

a frictional clutch mechanism interposed between the spindle and the first member of the driving mechanism, the frictional clutch mechanism transmitting rotation of the first member to the spindle according to the frictional force generated by pressing the driver bit to the work; and a claw clutch mechanism interposed between the spindle and the second member of the driving mechanism, the claw clutch mechanism being positioned at a disengaging position and an engaging position when the second member is Positioned at the first position and the second position, respectively.

The invention will become more fully apparent from the claims and the description as it proceeds in connection with the drawings.

DETAILED DESCRIPTION OF THE PREFERRED EMBODIMENT

Figure 1:
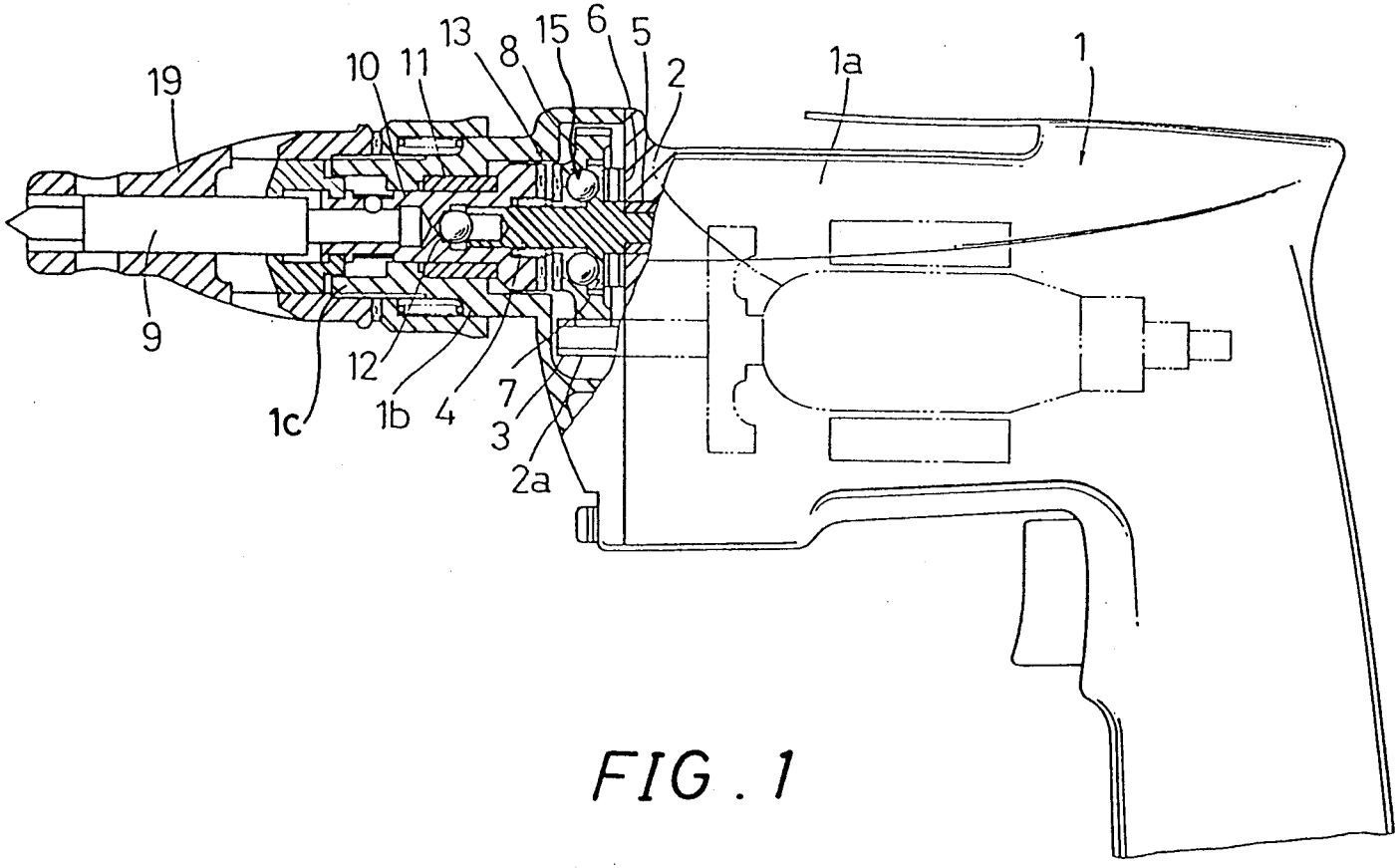
FIG. 1 is a side view of a power driven screwdriver according to a first embodiment of the present invention, with a part broken away for clarity.
Figure 2:
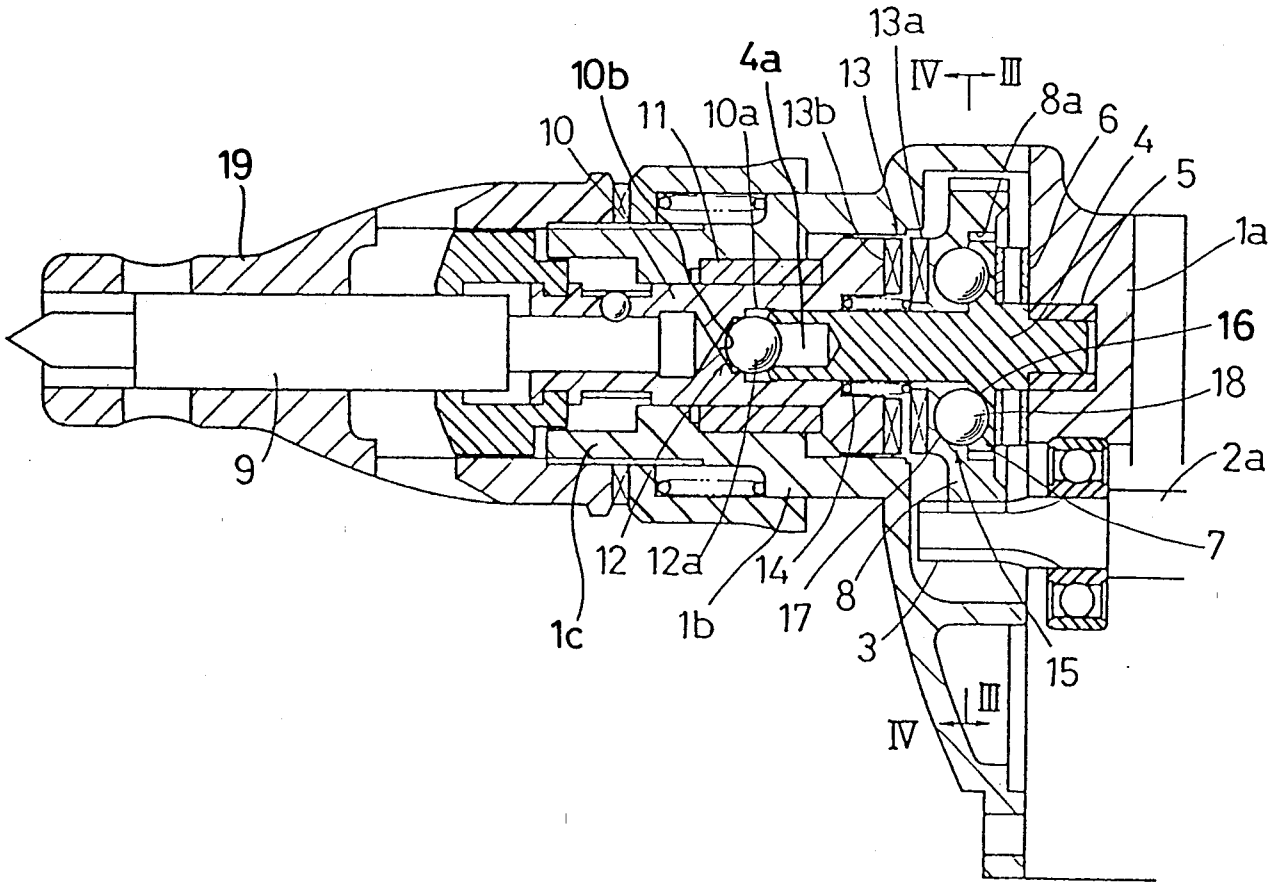
FIG. 2 is an enlarged sectional view of a main part of the power driven screwdriver shown in FIG. 1.
Figure 3:
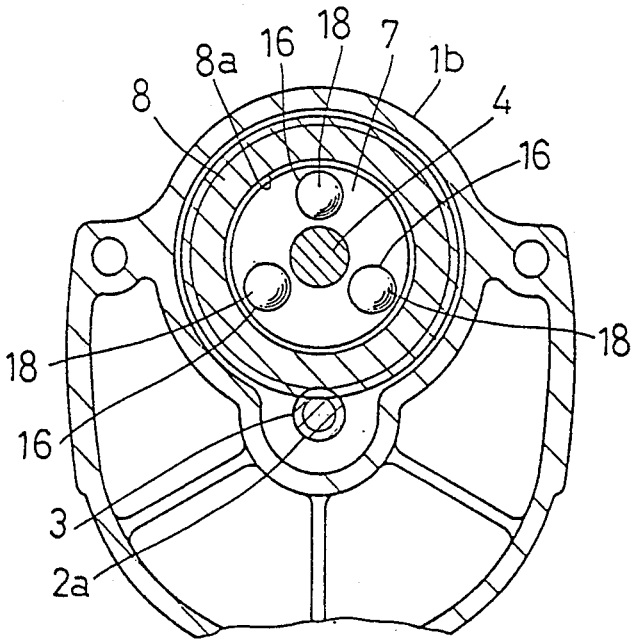
FIG. 3 is a sectional view taken along line III—III in FIG. 2.
Figure 4:
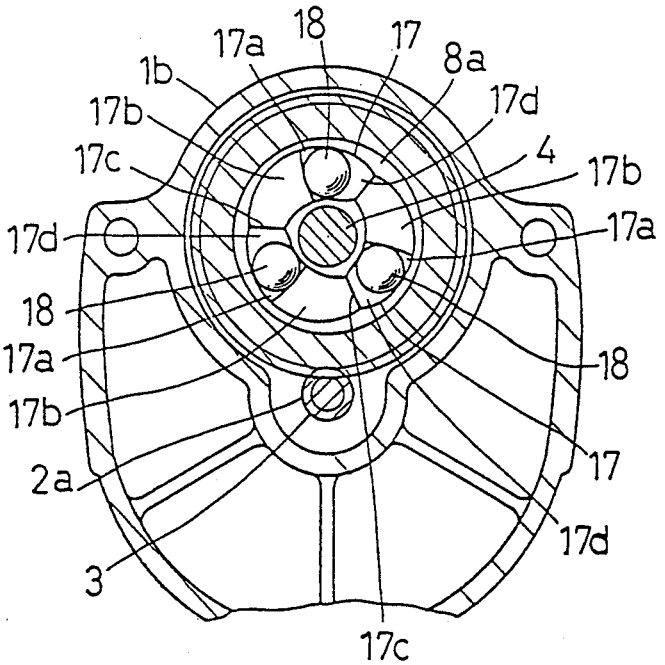
FIG. 4 is a sectional view taken along line IV—IV in FIG. 2.

Referring to FIGS. 1 to 5, there is shown a power driven screwdriver according to a first embodiment of the present invention. The power driven screwdriver 1 includes a motor housing 1*a* accommodating an electric motor 2 as a drive motor which can rotate in a forward direction and a reverse direction. The power driven screwdriver 1 further includes a gear housing 1*b* disposed adjacent the motor housing 1*a*. The end of a motor shaft 2*a* of the motor 2 extends to a position within the gear housing 1*b* and is provided with a gear 3 formed integrally therewith as shown in FIG. 2.

A cam shaft 4 is disposed within the gear housing 1*b*. The rear end of the cam shaft 4 is rotatably supported by the gear housing 1*b* through a metal bush 5 and a thrust bearing 6. A spindle 10 is rotatably supported by a cylindrical forward portion of the gear housing 1*b* through a metal bearing 11 and is disposed on the same axis as the longitudinal axis of the cam shaft 4. The forward end of the cam shaft 4 is rotatably supported by the spindle 10 through an axial hole 10*a* formed at the rear portion of the spindle 10. A driver bit 9 is mounted on the forward portion of the spindle 10. The cam shaft 4 includes an annular flanged portion 7 which extends radially outwardly from the cam shaft 4 and is positioned adjacent the thrust bearing 6.

A main gear 8 formed as a ring gear is rotatably mounted on the cam shaft 4 and is slidably movable in a longitudinal direction of the cam shaft 4. The main gear 8 includes at the rear side thereof a recess 8*a* for receiving the flanged portion 7 of the cam shaft 4 while permitting rotation of the flanged portion 7 relative thereto. The main gear 8 is in engagement with the gear 3 of the motor shaft 2*a*.

The spindle 10 is permitted to move in the axial direction at a short distance. The forward end of the cam shaft 4 inserted into the axial hole 10*a* is spaced from the bottom of the axial hole 10*a* at a predetermined distance so as to accommodate therebetween a frictional clutch mechanism 12 which transmits rotation of the cam shaft 4 to the spindle 10. The frictional clutch mechanism 12 includes a steel ball 12*a* which contacts a conical bottom surface 10*b* formed on the bottom of the axial hole 10*a* of the spindle 10. An axial hole 4*a* is formed on the forward end of the cam shaft 4 in opposed relation to the axial hole 10*a* of the spindle 10. The steel ball 12*a* also contacts the forward end of the cam shaft 4 and is partly received within the axial hole 4*a*.

A claw clutch mechanism 13 is provided between the main gear 8 and the rear end of the spindle 10. The claw clutch mechanism 13 includes a clutch member 13*a* formed on the forward surface of the main gear 8 and a clutch member 13*b* formed on the rear end surface of the spindle 10 for engagement with the clutch member 13*a*. A compression spring 14 is interposed between the main gear 8 and the spindle 10 so as to normally keep the clutch members 13*a* out of engagement with the clutch member 13*b*.

A cam mechanism 15 is provided between the flanged portion 7 of the cam shaft 4 and the bottom of the recess 8*a* of the main gear 8. The cam mechanism 15 includes three engaging recesses 16 formed on the front surface of the flanged portion 7 of the cam shaft 4 and equally spaced from each other in a circumferential direction, three control recesses 17 formed on the bottom surface of the recess 8*a* of the main gear 8 in opposed relation to the corresponding engaging recesses 16, respectively, and three control balls 18 made of steel and each interposed between the engaging recess 16 and the corresponding control recess 17 (see FIGS. 2 to 4).

Figure 5C:
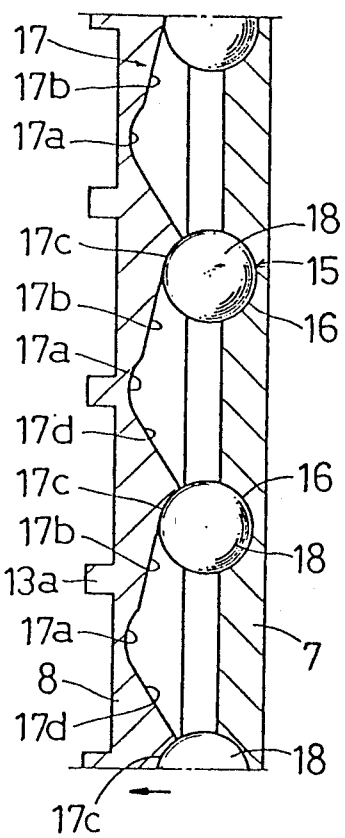
FIGS. 5A to 5C are views illustrating various operation of a cam mechanism in developed form.
Figure 5B:
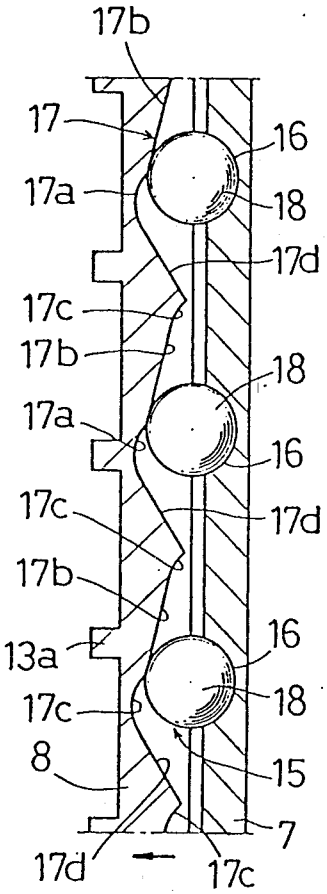
Figure 5A:
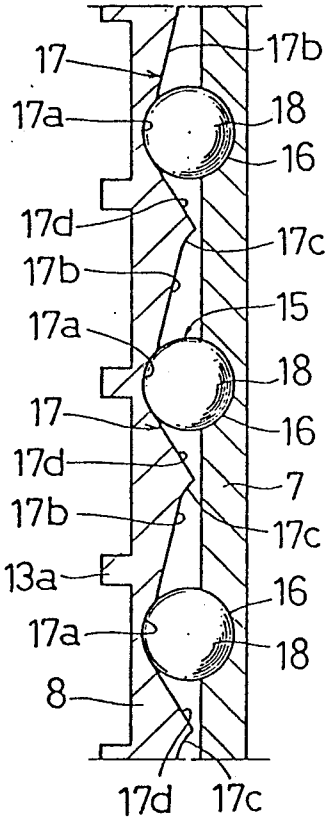

As shown in FIGS. 5A to 5C, each of the engaging recesses 16 is formed with hemispherical configuration and engages the corresponding control ball 18 not to move relative thereto while permitting rotation therewithin. Each of the control recesses 17 includes a first control surface 17*a*, a second control surface 17*b*, a third control surface 17*c* and a fourth control surface 17*d* formed in series in a circumferential direction. The first surface 17*a* is positioned at the bottom of the control recess 17 and has a configuration corresponding to a part of the spherical surface of the control ball 18. The second control surface 17*b* extends obliquely and outwardly from the first control surface 17*a* in a circumferential direction. The second control surface 17*b* has a configuration of circular arc in section in a radial direction. The third control surface 17*c* has a configuration corresponding to a part of the spherical surface of the control ball 18, as with the first control surface 17*a*, but extends obliquely and outwardly from the second control surface 17*b* in a circumferential direction. The fourth control surface 17*d* is formed in series with the first control surface 17*a* on the opposite side of the second control surface 17*b* and extends obliquely and outwardly from the first control surface 17*a*. Thus, the control recess 17 becomes shallower from the first surface 17*a* toward the third surface 17*c* and toward the fourth surface 17*d*. The fourth control surface 17*d* has a configuration of circular arc in section in a radial direction as the second surface 17*b*.

Thus, the main gear 8 changes its position along the cam shaft 4 according to the engaging position of the control balls 18 with their corresponding control recesses 17, and consequently the operation of the claw clutch mechanism 13 can be controlled. The relation between the engaging position of the control balls 18 of the cam mechanism !5 and the operation of the claw clutch mechanism 13 is normally determined in such a manner that clutch members 13*a* and 13*b* of the claw clutch mechanism 13 are disengaged when the control ball 18 is engaged with the first control surface 17*a* and that the clutch members 13*a* and 13*b* are sufficiently engaged with each other when the control ball 18 is engaged with the third control surface 17*c* as well as the shallowest portion of the fourth control surface 17*d*.

It is to be noted that the cam mechanism 15 transmits rotation of the main gear 8 to the cam shaft 4 through the control balls 18 since each of steel balls 18 always engages any one of the first to fourth control surface 17*a* to 17*d* of the corresponding control recess 17 and also engage the corresponding engaging recess 16 of the flanged portion 7.

The driver bit 9 is inserted into a stopper sleeve 19. The stopper sleeve 19 is threadably engaged with a cylindrical forward portion 1*c* of the gear housing 1*b*, so that the position of the stopper sleeve 19 relative to the forward portion 1*c* can be adjusted to determine the protruding distance of the driver bit 9 from the forward end of the stopper sleeve 19 according to the amount of driving of a screw to be obtained. A seal member 20 is interposed between the rear portion of the stopper sleeve 19 and the spindle 10 for preventing entry of dust into the gear housing 1*b*.

The operation of the above first embodiment will be hereinafter explained with reference to FIGS. 6A to 6D in connection with the driving operation of a screw.

Figure 6A:
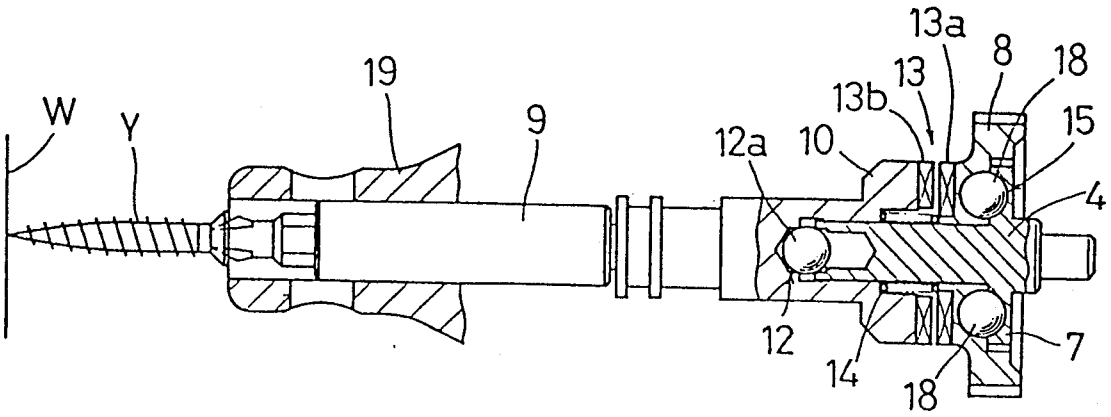
FIGS. 6A to 6D are schematic views illustrating various operation of the power driven screwdriver.
Figure 6B:
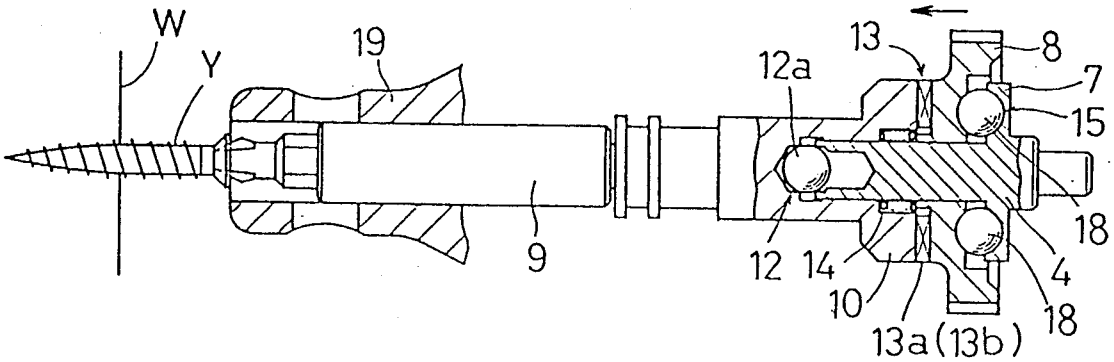

Firstly, the operator adjusts the position of the stopper sleeve 19 according to the driving amount of a screw Y to be obtained. The screw Y is thereafter held in contact relation at its head with the forward end of the driver bit 9 and is positioned to abut its end on a work W as shown in FIG. 6A.

In this stage, each of the controller steel balls 18 of the cam mechanism 15 engages the first control surface 17*a* of the corresponding control recess 17 as shown FIG. 5A, so that the claw clutch mechanism 13 is disengaged or the clutch members 13*a* and 13*b* are not engaged with each other. Thus, although the rotation of the motor 2 is transmitted to the main gear 8 and thereafter to the cam shaft 4 via the cam mechanism 15, the rotation of the cam shaft 4 is not transmitted to the spindle 10 or to the driver bit 9.

As the operator forces the screwdriver 1 toward the work W so as to press the driver bit 9 on the work W after the motor 2 has been started to rotate i the forward direction, the spindle 10 as well as the drive bit 9 is moved in the axial direction toward the main gear 8 at a little distance. With such axial force, the frictional clutch mechanism 12 transmits rotation of the cam shaft 4 to the spindle 10, so that the driver bit 9 is rotated to drive the screw Y. In case the load applied from the spindle 10 to the cam shaft 4 has become larger, the main gear 8 rotates relative to the flanged portion 7 of the cam shaft 4 in such a manner that each of the control balls 18 of the cam mechanism 15 moves from the first control surface 17*a* of the corresponding control recess 17 to the second control surface 17*b* passing over the ridge formed therebetween and thereafter moves to reach the third control surface 17*c* as shown in FIGS. 5A and 5B, so that the main gear 8 moves forwardly against the force of the spring 14. Thus, the clutch members 13*a* and 13*b* of the claw clutch mechanism 13 are sufficiently engaged with each other as shown FIG. 6B, so that the driving operation of the screw W by the driver bit 9 can be made with a stronger force.

Figure 6C:
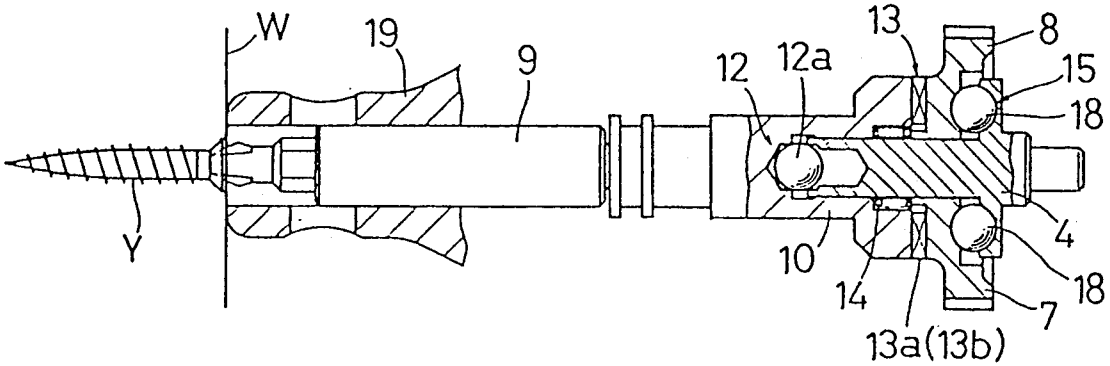
Figure 6D:
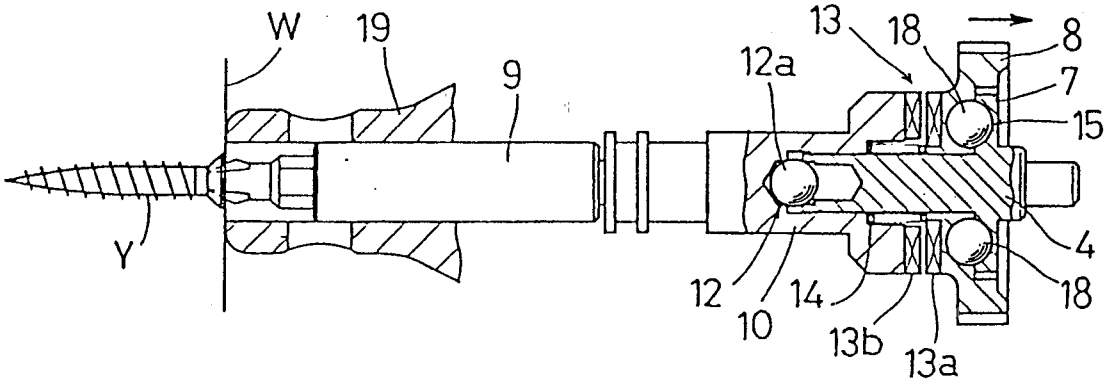

The screwdriver 1 is further forced forwardly toward the work W so as to further drive the screw Y until the forward end of the stopper sleeve 19 abuts on the work W as shown in FIG. 6C. In this stage, since no substantial force is applied to the driver bit 9 for pressing the same toward the spindle 10 by the pressing force of the screwdriver 1, the load from the spindle 4 applied to the cam shaft 4 is reduced. Thus, the torque transmitted from the cam shaft 4 to the spindle 10 is reduced. Such reduction of torque causes smooth movement of engaging position of each of the control balls 18 from the third control surface 17*c* to the first control surface 17*a* via the second control surface 17*b*by the spring 14 so as to disengage the claw clutch mechanism 13 as shown in FIG. 6D. In this stage, the rotation of the cam shaft 4 is no longer transmitted to the spindle 10 and the driving operation of the screw Y by the driver bit 9 is completed.

As described above, with the reduction of the torque transmitted from the cam shaft 4 to the spindle 10, each of the control balls 18 smoothly changes its engaging position from the third control surface 17*c* to the first control surface 17*a* via the second control surface 17*b*. After each of the control balls 18 has been once engaged with the first control surface 17*a*, they cannot be moved to the second control surface 17*b* passing over the ridge unless considerable axial force is applied to the spindle 10 for transmitting the required torque to the cam shaft 4 via the frictional clutch mechanism 12.

The clutch members 13*a* and 13*b* of the claw clutch mechanism 13 are therefore quickly and smoothly disengaged from each other and reliably maintain the disengaged position without generating clanging sounds.

Further, if the driving amount of the screw Y is not sufficient, the screwdriver 1 may be again pressed with a stronger force to press the spindle 10 toward the cam shaft 4, so that the frictional force is again produced between the spindle 10 and the cam shaft 4 to engage the claw clutch mechanism 13 for further driving the screw Y by the driver bit 19. Thus, an additional driving operation can be made.

Additionally, in this embodiment, when the motor 2 is rotated in the reverse direction with the driver bit 9 pressed on the screw Y which has been driven into the work W, each of the control balls 18 is moved to engage the fourth control surface 14*d* for engagement of the claw clutch mechanism 13, so that the release operation of the screw Y can be made.

Further, in the above embodiment the movement of the spindle 10 in an axial direction is required to the extent that the frictional force may be produced at the frictional clutch mechanism 12, and therefore the required distance of movement of the spindle becomes very little. This may prevent air within the gear housing 1*b* to become negative pressure at the driving operation of the screw Y, so that any dust may not enter the gear housing through the possible gap between the spindle 10 and the seal member 20.

A second embodiment of the present invention will be hereinafter explained with reference to FIGS. 7 to 9. The second embodiment is a modification of the first embodiment and has the same Construction as the first embodiment excepting the frictional clutch mechanism 12 and the cam mechanism, and therefore, in FIGS. 7 to 9, the same members as the first embodiment are labeled by the same numerals with the suffix "B" thereafter.

Figure 7:
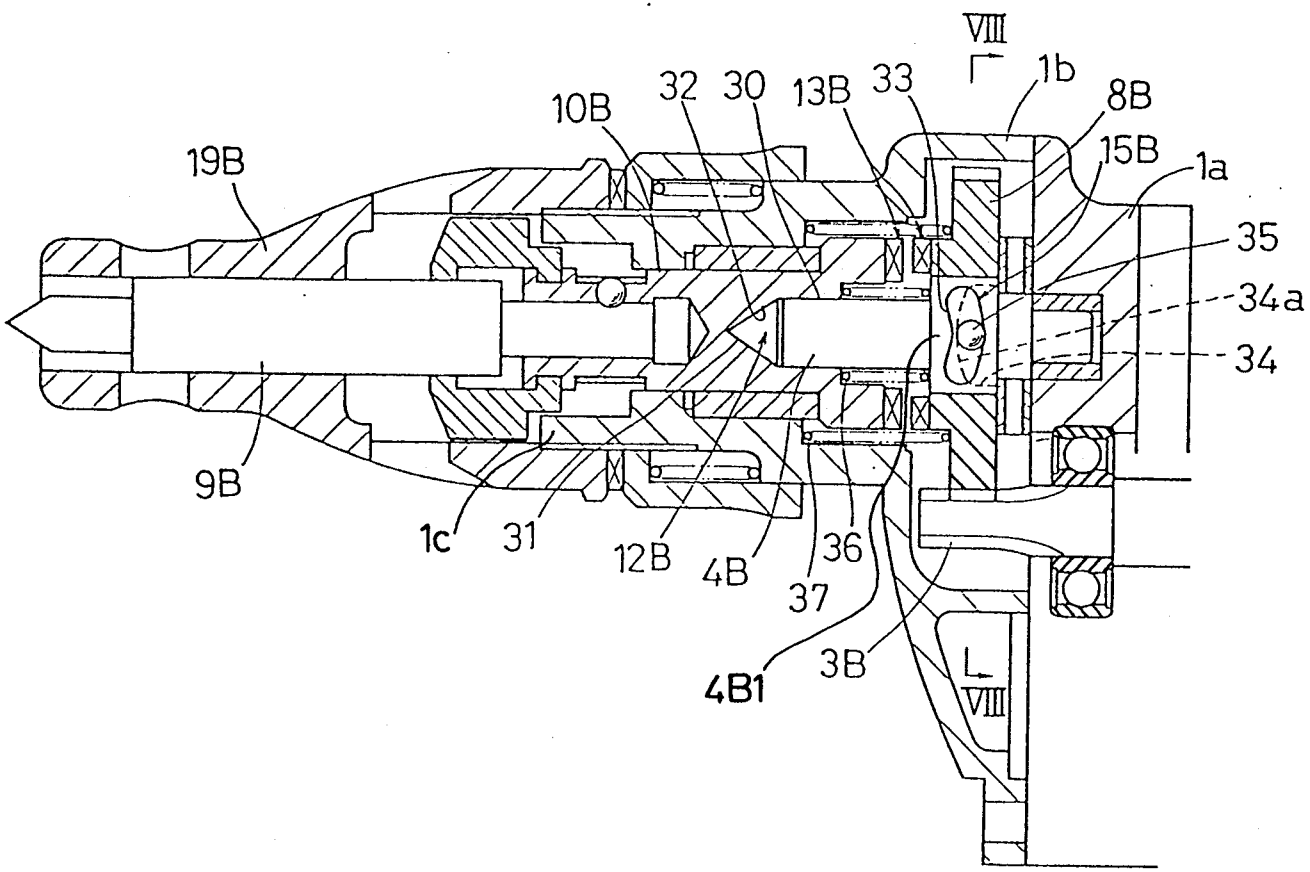
FIG. 7 is an enlarged sectional view of a main part of a power driven screwdriver according to a second embodiment of the present invention.

As shown in FIG. 7, a frictional clutch mechanism 12B of this embodiment does not include the steel ball 12*a* which is provided for the frictional clutch mechanism 12 of the first embodiment. The frictional clutch mechanism 12B includes a conical concave surface 31 formed on the bottom of an axial hole 30 of a spindle 10B, and a conical convex surface 32 which corresponds to the concave surface 31 and is formed on the forward end of a cam shaft 4B inserted into the axial hole 30. The concave surface 31 and the convex surface 32 is opposed to each other for transmitting rotation through the frictional force which may be produced when they have been pressed to each other.

The cam shaft 4B includes a mounting portion 4B1 having a larger diameter for slidably and rotatably mounting a main gear 8B.

Figure 9:
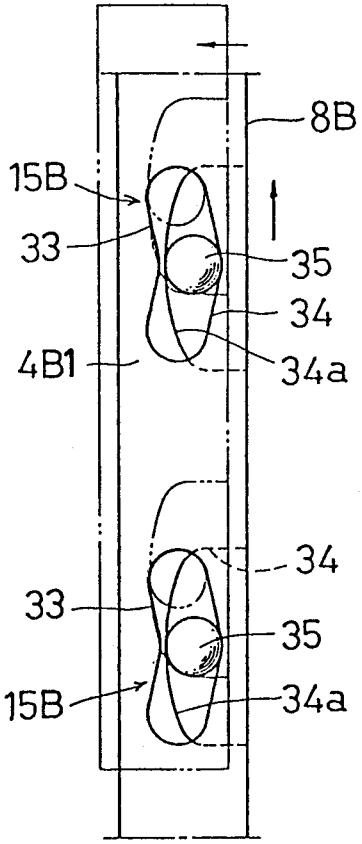
FIG. 9 is a view, in developed form, of a cam mechanism of the power driven screwdriver shown in FIG. 7.
Figure 8:
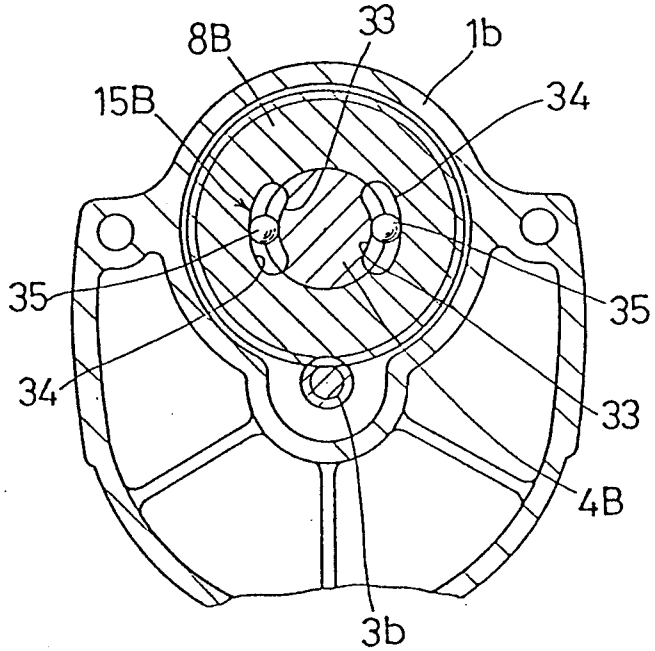
FIG. 8 is a sectional view taken along line VIII—VIII in FIG. 7.

A cam mechanism 15B is provided between the mounting portion 4B1 of the cam shaft 4B and the main gear 8B and includes a pair of cam recesses 33 formed on the mounting portion 4B1 in diametrically opposed relation to each other, a pair of partly circular recesses 34 formed on the inner surface of the main gear 8B in opposed relation to the cam recesses 33, respectively, and a pair of control balls 35 made of steel and each engaged with both the cam recess 33 and its opposed partly circular recess 34 as shown in FIGS. 8 and 9. Each of the cam recesses 33 is of substantially V-shaped configuration having a pair of branches extending forwardly obliquely relative to the circumferential direction of the cam shaft 4B. Each of the partly circular recesses 34 has substantially the same length as the cam recesses 33 in the circumferential direction. The partly circular recess 34 includes a circular arc surface 34*a* at its forward end while the rear end extends to the rear surface of the main gear 8*b*. The arc surface 34*a* extends obliquely rearwardly from the central portion thereof in the axial direction.

The relation between the operation of the cam mechanism 15B and the operation of a claw clutch mechanism 13B provided between the spindle 10B and the main gear 8B is determined as follows:

The clutch mechanism 13B is disengaged when the control ball 35 of the cam mechanism 13B is engaged with the central portion of the cam recess 33 or the most rightward position of the cam recess 33 while it is also engaged with the central portion of the arc surface 34*a* of the partly circular recess 34 or the most leftward position of the arc surface 34*a*.

On the other hand, as the control ball 35 moves leftwardly along any of the oblique branches of the cam recess 33 relative thereto while it moves rightwardly along the arc surface 34*a* relative thereto, the main gear 8A is moved leftwardly along the mounting portion 4B1 of the cam shaft 4, so that the claw clutch mechanism 13B becomes to be engaged. Thus, the cam mechanism 15B can operate to engage and disengage the claw clutch mechanism 13B in either direction of rotation of the motor 2. When the main gear 8A is rotated relative to the mounting portion 4B1 to engage the control ball 35 with the most leftward.portions of the cam recess 33 and with the most rightward portions of the arc surface 34*a*, the claw clutch mechanism 138 is sufficiently engaged.

A first spring 36 is interposed between the mounting portion 4B1 of the cam shaft 4 and the spindle 10B, and a second spring 37 is interposed between the inner wall of the gear housing 1*b* and the main gear 8B. Both the first and second springs 36 and 37 operate to normally keep the claw clutch mechanism 13B at disengaging position.

Thus, in the frictional clutch mechanism 12B of the second embodiment, the transmission of rotation from the cam shaft 4B to the spindle 8B is performed by the direct contact between the conical convex surface 32 of the cam shaft 4B and the conical concave surface 31 of the spindle 31. Further, in the cam mechanism 15B of the second embodiment, control of the claw clutch mechanism 13B is performed through cooperation of the control balls 35 with their corresponding cam recesses 33 formed on the cam shaft 4B and the arc surfaces 34*a* of the partly circular recesses formed on the main gear 8B. The other operation and effect of the second embodiment are the same as those of the first embodiment.

Figure 10:
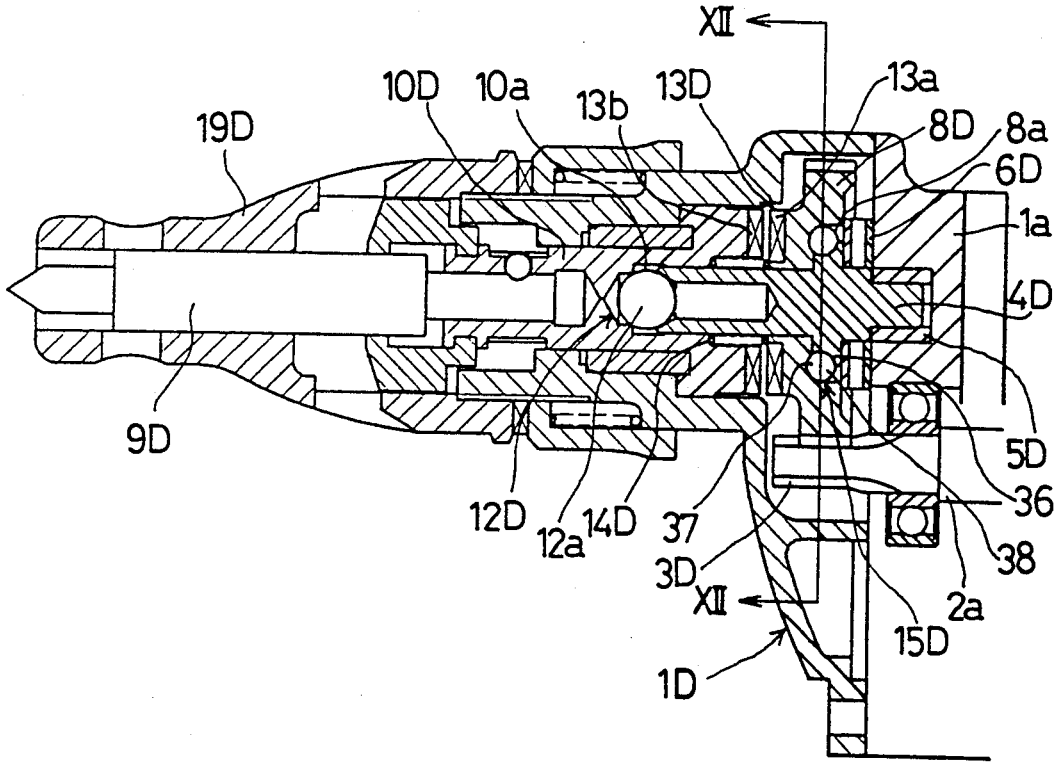
FIG. 10 is an enlarged sectional view of a main part of a power driven screwdriver according to a third embodiment of the present invention.

A third embodiment of the present invention will be hereinafter explained with reference to FIGS. 10 to 12 and A to 13C. The third embodiment is a modification of the first embodiment and has the same construction as the first embodiment excepting the construction of the engaging recesses 16 and the control recess 17 of the cam mechanism and, and therefore, in FIGS. 10 to 13D, the same members as the first embodiment are labeled by the same numerals with the suffix "D" thereafter.

Figure 13A:
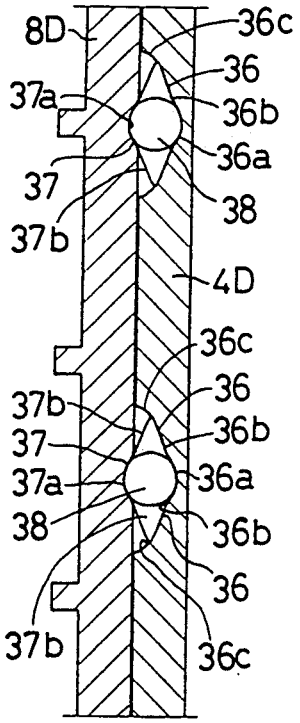
FIGS. 13A to 13C are views illustrating various operation of a cam mechanism of the third embodiment in developed form.
Figure 13B:
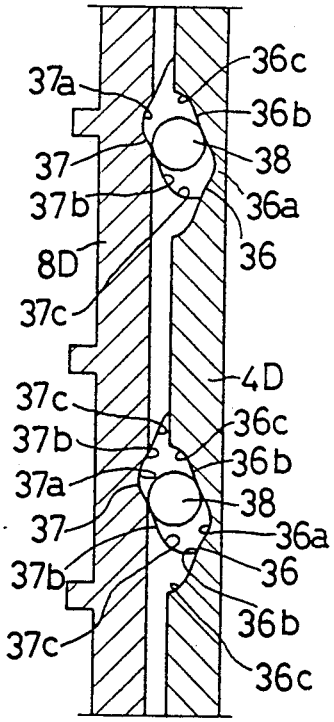
Figure 13C:
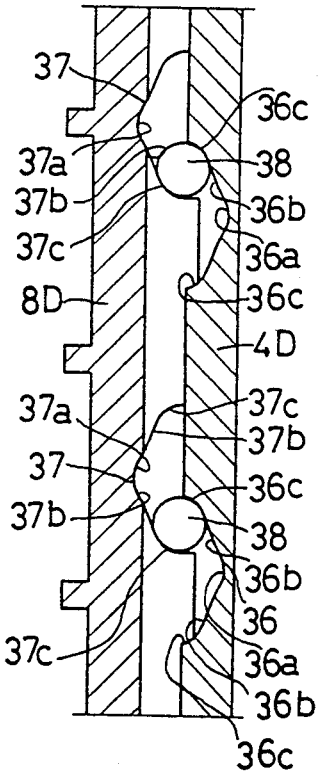

A cam mechanism 15D provided between the flanged portion 7D of the cam shaft 4D and the recess 8*a* of the main gear 8 includes two first control recesses 36 formed on the peripheral portion of the front surface of the flanged portion 7D of the cam shaft 4D and equally spaced from each other in a circumferential direction, two second control recesses 37 formed on the peripheral portion of the bottom of the recess 8*a* of the main gear 8 in opposed relation to the corresponding first control recesses 36, respectively, and two control balls 38 made of steel and each interposed between the first control recess 36 and the corresponding second control recess 37 . As shown in FIGS. 13A to 13C, each of the first control recesses 16 is formed with substantially V-shaped configuration and includes a first control surface 36*a*, a pair of second control surfaces 36*b* and a pair of third control surfaces 36*c*. The first surface 36*a* is positioned at the bottom of the first control recess 36 and has a configuration corresponding to a part of the spherical surface of the control ball 38. The second control surfaces 36*b* are disposed at both sides of the first control recess 36*a* in a circumferential direction and extend obliquely and outwardly from the first control surface 36*a*. Each of the second control surfaces 36*b* has a configuration of circular arc in section in a radial direction. The third control surfaces 36*c* are formed in series with the corresponding second control surface 36*b*, respectively. Each of the third control surface 36*c* has a configuration corresponding to a part of the spherical surface of the control ball 38, as with the first control surface 36*a*, but extends obliquely and outwardly from the second control surface 36*b*. Thus, the control recess 36 becomes shallower from the first surface 36*a* toward the third surfaces 36*c*.

Each of the second control recesses 37 is formed with substantially the same configuration as the first control recess 36 and includes a first control surface 37*a*, a pair of second control surfaces 37*b* and a pair of third control surfaces 37*c* corresponding to the first control surface 36*a*, a pair of the second control surfaces 36*b* and a pair of the third control surfaces 36*c*, respectively.

The relation between the engaging position of the control balls 38 of the cam mechanism 15D and the operation of a claw clutch mechanism 13D is normally determined in such a manner that clutch members 13*a* and 13*b* of the claw clutch mechanism 13D are disengaged when the control ball 38 is engaged with the first control surface 36*a* of the first control recess 36 and is also engaged with the first control surface 37*a* of the second control recess 37 as shown in FIG. 13A and that the clutch members 13*a* and 13*b* are sufficiently engaged with each other when the control ball 38 is engaged with one of the third control surfaces 36*c* of the first control surface 36 and one of the third control surfaces 37*c* of the second control surface 37 positioned at opposite side of one of the third control surfaces 37*c* in a circumferential direction as shown in FIG. 13C.

The operation of the above third embodiment will be hereinafter explained.

Figure 11:
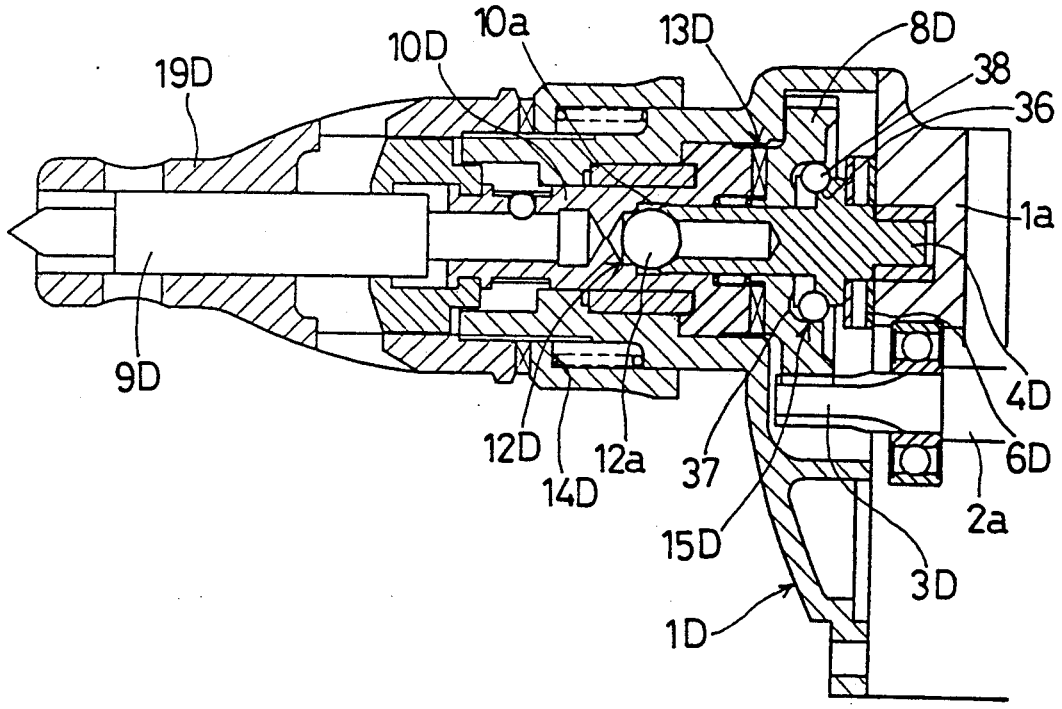
FIG. 11 is a view similar to FIG. 10 but showing a different operation.
Figure 12:
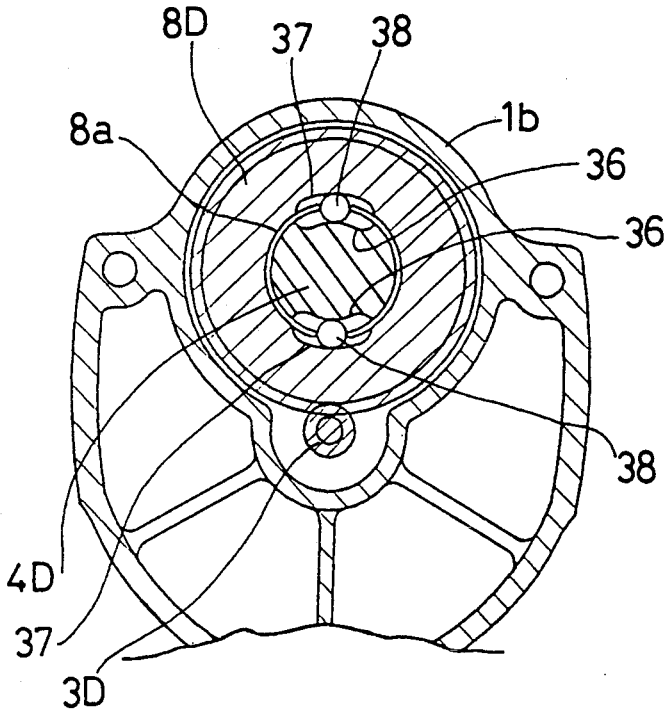
FIG. 12 is a sectional view taken along line XII—XII in FIG. 10.

When the control balls 38 of the cam mechanism 15D engages the first control surface 36*a* of the first control recess 36 and the first control surface 37*a* of the second control recess 37 as shown in FIGS. 11 and 13A, the claw clutch mechanism 13D is disengaged or the clutch members 13*a* and 13*b* are not engaged with each other. Thus, although the rotation of the motor 2 is transmitted to the main gear 8D and thereafter to the cam shaft 4D via the cam mechanism 5D, the rotation of the cam shaft 4 is not transmitted to a spindle 10D or to a driver bit 9D.

As the operator forces the screwdriver 1D toward the work so as to press the driver bit 9D on a work after a motor has been started to rotate in a forward direction, the spindle 10D as well as the driver bit 9D is moved in the axial direction toward the main gear 8D at a little distance. With such axial force, the frictional clutch mechanism 12D transmits rotation of the cam shaft 4D to the spindle 10D, so that the driver bit 9D is rotated. In case the load applied from the spindle 10D to the cam shaft 4D has become larger, the main gear 8D rotates relative to the flanged portion 7D of the cam shaft 4D in such a manner that each of the control balls 38 of the cam mechanism 15D moves from the first control surface 36*a* of the corresponding first control recess 36 to one of the second control surfaces 36*b* passing over the ridge formed therebetween and thereafter moves to reach one of the third control surfaces 36*c* as shown in FIGS. 13B and 13C. Each of the control steel balls 38 also moves from the first control surface 37*a* of the corresponding second control recess 37 to one of the second control surface 37*b* to reach one of the third control surfaces 37*c* positioned at opposite side of one of the third control surface 36*c* of the first control recess 36. The main gear 8D, therefore, moves forwardly against the force of a spring 14D. Thus, the clutch members 13*a* and 13*b* of the claw clutch mechanism 13D are sufficiently engaged with each other as shown in FIG. 11, so that the driving operation by the driver bit 9D can be made with a stronger force.

It is to be noted that the operation for releasing the screw can be made by rotating the motor in the reverse direction through engagement of each of the control balls 38 with the other of the third control surfaces 36*c* of the first control recess 36 and the other of the third control surfaces 37*c* of the second control recess 37.

Thus, the third embodiment has substantially the same operation as the first embodiment.

The construction of the clutch mechanisms of the above first to third embodiments are also applicable to a pneumatic screwdriver.

While the invention has been described with reference to preferred embodiments thereof, it is to be understood that modifications or variations may be easily made without departing from the scope of the present invention which is defined by the appended claims.

What is claimed is:

1. A power driven screwdriver comprising:

a housing;

a drive motor mounted within said housing;

a spindle rotatably mounted within said housing for engagement with a driver bit for driving a screw;

a driving mechanism interposed between said drive motor and said spindle for transmitting rotation of said drive motor to said spindle, said driving mechanism including a first member rotatably mounted within said housing and a second member movably mounted on said first member and driven by said drive motor;

a cam mechanism interposed between said first member and said second member of said driving mechanism, said cam mechanism interconnecting said first member with said second member for transmitting rotation of said second member to said first member and for permitting said second member to move relative to said first member between a first position and a second position;

biasing means for normally keeping said second member at said first position and for permitting said second member to move from said first position to said second Position as torque transmitted from said second member to said first member increases;

a frictional clutch mechanism interposed between said spindle and said first member of said driving mechanism, said frictional clutch mechanism transmitting rotation of said first member to said spindle according to the frictional force generated by pressing said driver bit to the work; and a claw clutch mechanism interposed between said spindle and said second member of said driving mechanism, said claw clutch mechanism being positioned at a disengaging position and an engaging position when said second member is positioned at said first position and said second position, respectively.

2. The power driven screwdriver as defined in claim 1 wherein said first member of said driving mechanism is a shaft rotatably supported by said housing and is disposed in the same axis as said spindle and wherein said second member is a gear mounted on the first member coaxially therewith.

3. The power driven screwdriver as defined in claim 2 wherein said second member moves between said first position and said second position in an axial direction of said first member.

4. The power driven screwdriver as defined in claim 1 wherein said cam mechanism includes a first recess formed on said first member of said driving mechanism, a second recess formed on the second member in opposed relation to said first recess, and a ball interposed between said first member and said second member and engaging both said first recess and said second recess.

5. The power driven screwdriver as defined in claim 4 wherein said first recess and said second recess are opposed to each other in an axial direction of said second member; said first recess engages said ball to secure its position in a circumferential direction; and said second recess varies its depth in the circumferential direction, so that said ball can be engaged with the second recess at different depths.

6. The power driven screwdriver as defined in claim 5 wherein said second recess includes a first surface, a second surface and a third surface formed in series in the circumferential direction in such a manner that the depth of said second recess becomes shallower from said first surface to said third surface, said first and third surfaces being formed with a spherical configuration corresponding to said ball, and said second surface being inclined to connect said first surface and said third surface; and wherein said second member is positioned at said first position and said second position when said ball is engaged with said first surface and said third surface, respectively.

7. The power driven screwdriver as defined in claim 6 wherein said second recess further includes a fourth surface formed in series with said first surface in the circumferential direction on the opposite side of said second surface, said fourth surface is inclined to become shallower away from said first surface, and said second member is positioned at said second position when said ball engages said fourth surface at its shallowest position.

8. The power driven screwdriver as defined in claim 4 wherein said first recess and said second recess are opposed to each other in a radial direction and are provided with cam surfaces which engage said ball at opposite sides in an axial direction and which extend in a circumferential direction, respectively; and wherein at least one of said cam surfaces varies its engaging position of said ball in an axial direction .

9. The power driven screwdriver as defined in claim 8 wherein said cam surface of said first recess has a configuration of circular arc; said cam surface of s id second recess has substantially V-shaped configuration, the branches of which are inclined relative to the circumferential direction at a predetermined angle inversely to said cam surface of said first recess; said ball engages both central portions of said cam surfaces of said first and second recesses when said second member is positioned at said first position, while said ball engages one end of said cam surface of said first recess and engages one end of said cam surface of said second recess in a direction opposite to said one end of said cam surface of said first recess.

10. The power driven screwdriver as defined in claim 4 wherein said first recess and said second recess are opposed to each other in an axial direction of said first member; each of said first and second recesses has substantially V-shaped configuration in such a manner that the depth in the axial direction becomes shallower from the central portion thereof toward both end portions in a circumferential direction; said second member is positioned at said first Position when said ball engages said central portions of both said first and second recesses while said second member is positioned at said second position when said ball engages one of said end portions of said first recess and also engages one of said end portions of said second recess in a direction opposite to said one of said end portions of said first recess.

11. The power driven screwdriver as defined in claim 10 wherein each of said first and second recesses includes a first surface formed on said central portion, a pair of second surfaces and a pair of third surfaces formed on said end portions and connected in series with said first surface via said second surfaces, respectively; each of said first and said third surfaces has a spherical configuration corresponding to said ball; and each of said second surfaces obliquely extends from said first surface to corresponding said third surface.

12. The power driven screwdriver as defined in claim 1 and further including a stopper sleeve attached to the forward end of said housing for abutting on a work to be screwed, the position of said stopper sleeve being adjustable relative to said housing in the axial direction, so that the amount of driving of the screw into the work can be varied.

13. The power driven screwdriver as defined in claim 1 wherein said bias means is a spring interposed between said spindle and said second member of said driving mechanism.

14. The power driven screwdriver as defined in claim 1 wherein said claw clutch mechanism includes a first clutch member mounted on the rear end of said spindle and a second clutch member mounted on the forward end of said second member for engagement with said first clutch member.

15. The power driven screwdriver as defined in claim 1 wherein said frictional clutch mechanism includes a ball member interposed between the rear end of s id spindle and the forward end of said first member, and bearing portions formed on the rear end of said spindle and the forward end of said first member, respectively, for supporting said ball member.

16. The power driven screwdriver as defined in claim 1 wherein said frictional clutch mechanism includes a conical convex surface and a conical concave surface corresponding thereto formed on the rear end of the spindle a d the forward end of said first member.

* * * * *